United States Patent [19]

Rendel et al.

[11] Patent Number: 4,739,153

[45] Date of Patent: Apr. 19, 1988

[54] WALL MOUNTED ELECTRIC ROOM HEATER

[76] Inventors: Robert D. Rendel, Rte. 1, Box 826, Laurinburg, N.C. 28352; James P. Shawcross, 402 Burris Rd., Florence, S.C. 29501

[21] Appl. No.: 869,732

[22] Filed: Jun. 2, 1986

[51] Int. Cl.[4] ..... H05B 1/00; F24H 3/00; F24H 9/02

[52] U.S. Cl. ..... 219/368; 126/110 B; 165/122; 219/366; 219/370; 219/375

[58] Field of Search ..... 219/364–370, 219/374–376, 359, 361; 165/122, 121; 126/110 R, 110 B

[56] References Cited

U.S. PATENT DOCUMENTS

| | | | |
|---|---|---|---|
| 1,926,537 | 9/1933 | Hoffman | 219/364 |
| 1,948,759 | 2/1934 | Hoffman | 219/364 X |
| 1,982,139 | 11/1934 | Kercher | 219/367 |
| 2,014,644 | 9/1935 | Birkholz | 219/366 |
| 2,120,795 | 6/1938 | Boothby | 219/366 |
| 2,260,233 | 10/1941 | Ripley | 219/368 |
| 2,506,408 | 5/1950 | Aufiero | 219/370 X |
| 2,852,657 | 9/1958 | Markel et al. | 219/370 X |
| 3,176,117 | 3/1965 | Knoll et al. | 219/375 X |
| 4,341,946 | 7/1982 | Ohnmacht et al. | 219/370 X |

FOREIGN PATENT DOCUMENTS

| | | | |
|---|---|---|---|
| 2497049 | 6/1982 | France | 219/375 |

*Primary Examiner*—Anthony Bartis

*Attorney, Agent, or Firm*—Polster, Polster and Lucchesi

[57] ABSTRACT

A wall mounted electric room heater includes a wall box adapted to be secured between a pair of wall studs and having an open front and side walls extending from a back wall. A heater/blower assembly carried by a frame is disposed in the box and includes and electric resistance heating element mounted in a venturi having an inlet spaced from the back wall and an outlet communicating with the open front. A fan is mounted within the venturi for drawing air from the room through the open front into the wall box outside the venturi to the venturi inlet for flow through the venturi over the heating element to be heated and discharge from the venturi outlet and through the open front into the room. An air straightener as installed on the venturi downstream of the fan for causing the heated air to discharge from the venturi outlet in substantially axial direction to prevent the heated air from being entrained with the room air being drawn into the wall box by the fan. A louvered grill overlies the open front of the box and the air straightener. A partition carried by the frame cooperates with the back and side walls of the box to define a wiring compartment.

8 Claims, 3 Drawing Sheets

WALL MOUNTED ELECTRIC ROOM HEATER

BACKGROUND OF THE INVENTION

This invention relates to an electrical resistance wall heater, and more particularly to a wall heater which is primarily intended to be permanently mounted within the wall of a building by fixedly mounting a wall box to a structural wall member (e.g., a stud), with the wall box extending out through an opening in the wall sheathing. A combination blower/heater assembly is mounted within the wall box so as to draw room air into the wall box, pass it over the heater, and forcibly discharge the heated air into the room.

Generally, portable, fan forced heaters typically forcibly draw cool, room air in through the back of the heater passed it over an electrical resistance heating element, and force the air out the front of the heater, with the air traveling substantially in axial direction through the heater. This axial flow of air through the heater ensured that cool room air was freely drawn into the heater and uniformly passed over the heating elements thereby to ensure that the heating element works at a desired operating temperature such that the tips or other portions of the heating elements would not be heated to visible incandescent temperatures at which they would glow red.

However, in built-in wall heaters which are enclosed within the wall of a building, the inlet air is typically drawn into the heating element via an inlet opening, passed over the heating elements, and then discharged from an outlet opening separate and apart from the inlet opening. However, the incoming air oftentimes drew some of the discharged heated air back into the heater. This increased inlet air temperature and caused some or all of the open heater coil elements to operate above their desired temperature level (i.e., to glow red). The fact that some or all of the heating elements might glow red was undesirable because this shortened the operating life of the heating element, caused concern on the part of consumers utilizing the heater, and resulted in less operating efficiency for the heater.

Further, in many prior art wall heaters, the heating element and fan unit were difficult to electrically connect within the roughed-in wall box mounted within the wall. Typically, with prior art wall heaters, the wall box mount was mounted within the wall and a portion of the wall box was in register with an opening in the wall sheathing. A power wiring within the wall extended through a knock-out opening in the wall box. In these prior art wall heaters, it was necessary for the installer to physically position the heater/blower assembly proximate the wall box. While holding the relatively heavy heater/blower assembly in close proximity, but not fully installed in the wall box, manually making the electrical connections between the heater wiring harness and the electrical supply line. Only after the electrical connections were fully made could the heater/-blower assembly be secured in position within the wall box. This oftentimes increased the labor and costs involved with installing such wall heaters. Additionally, this task was oftentimes difficult to do because the heater wiring harness would be of relatively short length, thus requiring the installers to make the wiring connections with little or no access to the wiring ends where the wiring connections were to be made.

Also, with prior art wall heaters having separate inlet and outlet openings, the openings were relatively small (as compared to the size of the wall box) and they were spaced apart so as to prevent entrainment of the discharged heated air with the incoming room air. Thus, the overall size of these prior art wall heaters tended to be somewhat undesirably large so as to accommodate the separate inlet and outlet openings, and so as to ensure that there was adequate separation between the inlet and outlet openings thereby to effectively prevent the heated air discharge from the outlet opening becoming entrained with the room air being drawn into the heater.

SUMMARY OF THE INVENTION

Among the several objects and features of the present invention may be noted the provision of a wall heater which uses a common grill having louver openings therein, with a portion of the louver openings constituting an inlet opening for the wall heater, and with other portions of the louver openings constituting discharge openings, but yet so that there is no substantial amount of entrainment of the heated air discharged from the heater being entrained with the room air being drawn into the heater;

The provision of such a wall heater which efficiently draws air into the heater, uniformly removes heat from the heating element such that none of the heating element glows red when in operation, and forcefully directs the heated air out into the room;

The provision of such a wall heater in which the air may be drawn generally perpendicularly inwardly of the wall box, drawn toward a generally centrally located venturi and discharged back into the room, and yet the depth of the wall box is such that it may be readily installed in walls of conventional construction (i.e., walls of a standard thickness) without interfering with the wall sheathing (or other material) on the opposite side of the wall;

The provision of such a wall heater which significantly reduces recirculation of heated air discharged into the room and which reduces mixing of the heated air with room air being drawn into the heater thereby to maximize the heat discharged into the room and to maximize the efficiency of the heater;

The provision of such a wall heater which effectively blocks the entrance of foreign objects into the fan blade and heater element;

The provision of such a wall heater which does not create any substantial back pressure within the heater/-blower assembly thereby to maximize air flow through the heater;

The provision of such a wall heater in which a portion of the heater frame assembly, when installed in the wall box, cooperates with portions of the wall box thereby to form a wiring compartment so as to physically isolate the electrical connection of the heater/-blower assembly to the house wiring in conformance with Underwriters Laboratories (U.L.) requirements;

The provision of such a wall heater which facilitates installation of the heater and frees both hands of the installer for making the wiring connections of the wiring harness to the house wiring;

The provision of such a wall heater which is relatively quiet in operation;

The provision of such a wall heater which, during operation, results in a relatively low operating temperature for the wall box (i.e., below 90° C., or 195° F.);

The provision of such a wall heater which discharges a "column" of heated air well out into the room thereby to aid in circulation of the heated air within the room;

The provision of such a wall heater which utilizes a grill having louvers with portions of the louvers serving as inlet air openings and with other portions of the louver openings serving as a discharge opening, with the louver openings being sized relative to the heater assembly such that substantially all of the louvers openings is utilized either for air intake or air discharge;

The provision of such a wall heater which permits blind installation of the wall box within a wall of dry wall construction (i.e., 2×4 vertical wall studs faced with ⅜ inch plasterboard sheathing) wherein the side of the box opposite the wall stud to which the box is securely mounted is supported relative to the wall sheathing; and The provision of such a wall heater which is of rugged and economical construction, which is efficient in operation, and which has a long service life.

Other objects and features of this invention will be in part apparent and in part pointed out hereinafter.

Briefly stated, a wall heater of the present invention comprises a wall box adapted to be secured to structural members of a wall. The wall has sheathing material attached to the structural members, with the sheathing material having an opening therein for registration with the wall box. The wall box has a back wall and side walls extending out from the back wall. A frame assembly is secured to the wall box, with this frame assembly including a frame adapted to bear against the outer face of the sheathing around the opening. A partition extends into the wall box from the frame assembly and cooperates with the back wall and the side walls so as to define a wiring compartment within the wall box. A heater/blower assembly is carried by the frame and is disposed within the wall box when the frame assembly is mounted on the wall box in a heater compartment within the wall box on the side of the partition opposite the wiring compartment. The heater/blower assembly comprises a venturi having a throat and an inlet tube leading to the throat, with the throat being of a cross section less than the inlet tube. An electrical resistance heating element and a fan are mounted within the venturi for drawing air into the heater/blower compartment on the outside of the venturi, for drawing air into the inlet end of the venturi proximate the back wall of the wall box, for passing the air over the heating element, and for discharging heated air into the room.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
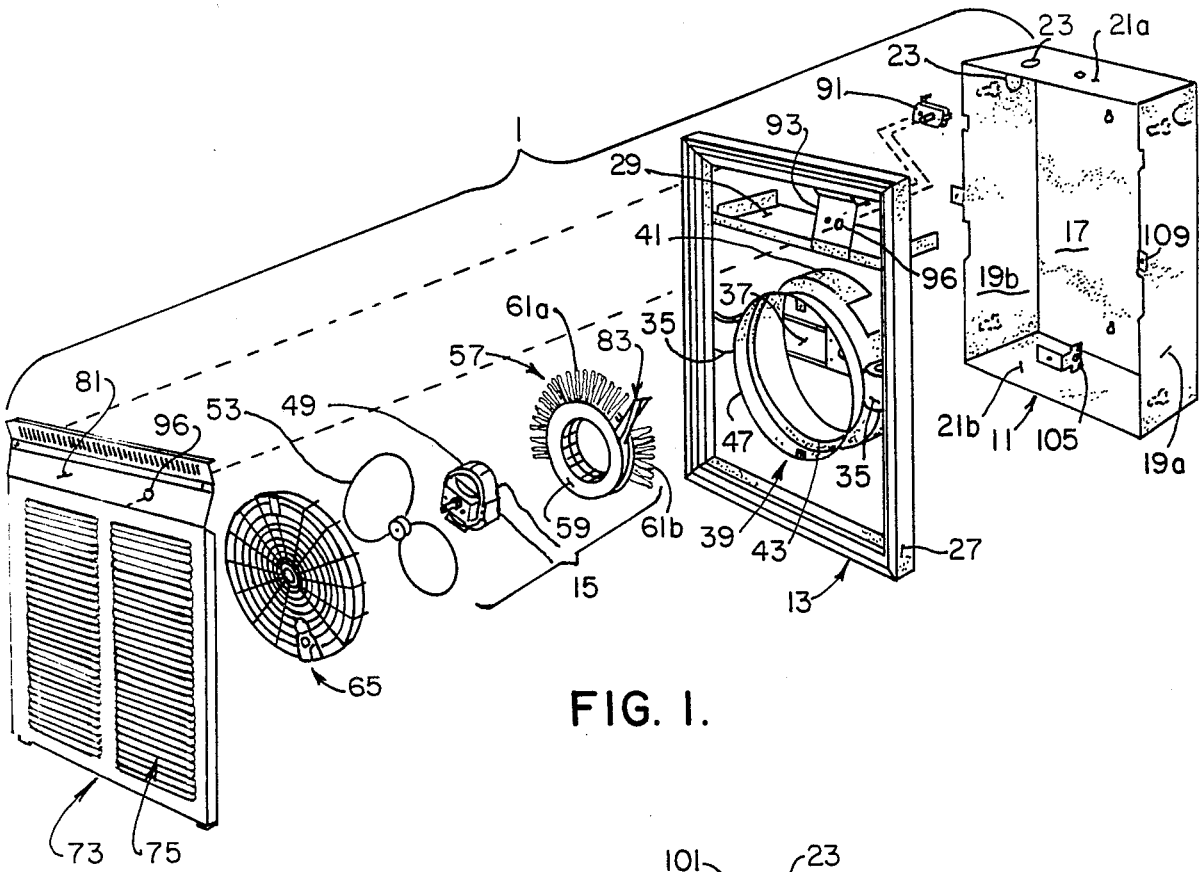
FIG. 1 is an exploded perspective view of a wall heater of the present invention.
Figure 6:
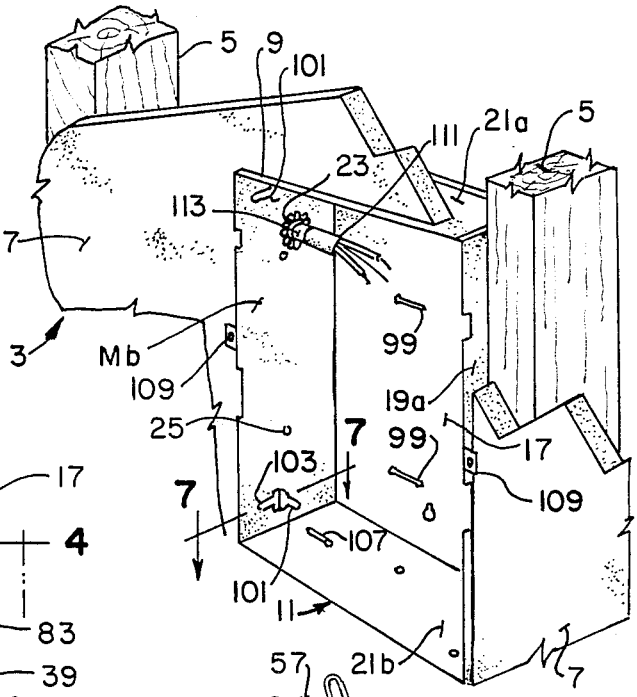
FIG. 6 is a partial perspective view of the wall box mounted to a stud within a wall, with the wall box being generally in register with an opening in wall sheathing material applied to the wall.

Referring now to the drawings, and particularly to FIG. 1, a wall heater of the present invention is indicated in its entirety by reference character 1. As shown in FIG. 6, wall heater 1 is intended to be mounted, in a recessed fashion, within a wall 3. The wall construction is, as is typical, comprised of a plurality of vertical, spaced-apart studs 5 (e.g., 2×4's) having wall sheathing material (dry wall) 7 secured to the outer faces of the studs. An opening, as indicated at 9, is provided in wall sheathing 7 for receiving a rough-in wall box 11 constituting a portion of wall heater 1. The manner in which wall box 11 is secured to studs 5 will be discussed in detail hereinafter.

Referring now to FIG. 1, wall heater 1 is shown to comprise the heretofore mentioned wall box 11. A frame assembly, as generally indicated at 13, may be fixedly secured to wall box 11. A heater/blower assembly, as generally indicated at 15, is carried by frame assembly 13 and is mounted within wall box 11. More specifically, wall box 11 comprises a back wall 17 and side walls **19*a*, 19*b* extending outwardly from the back wall and end walls 21*a*, 21*b* also extending outwardly from the back wall. Wiring knock-out openings 23 are provided in side wall 19*b* and end wall 21*a*, so as to permit electrical house wiring 111, as shown in FIG. 6, to be secured to and to enter wall box 11 in a manner as will hereinafter appear. Each of the side walls 19*a*, 19*b* is provided with a plurality of nail apertures 25 which permit the wall box to be secured (nailed) to a side face of a respective stud 5 in the manner as shown in FIG. 6**.

Figure 2:
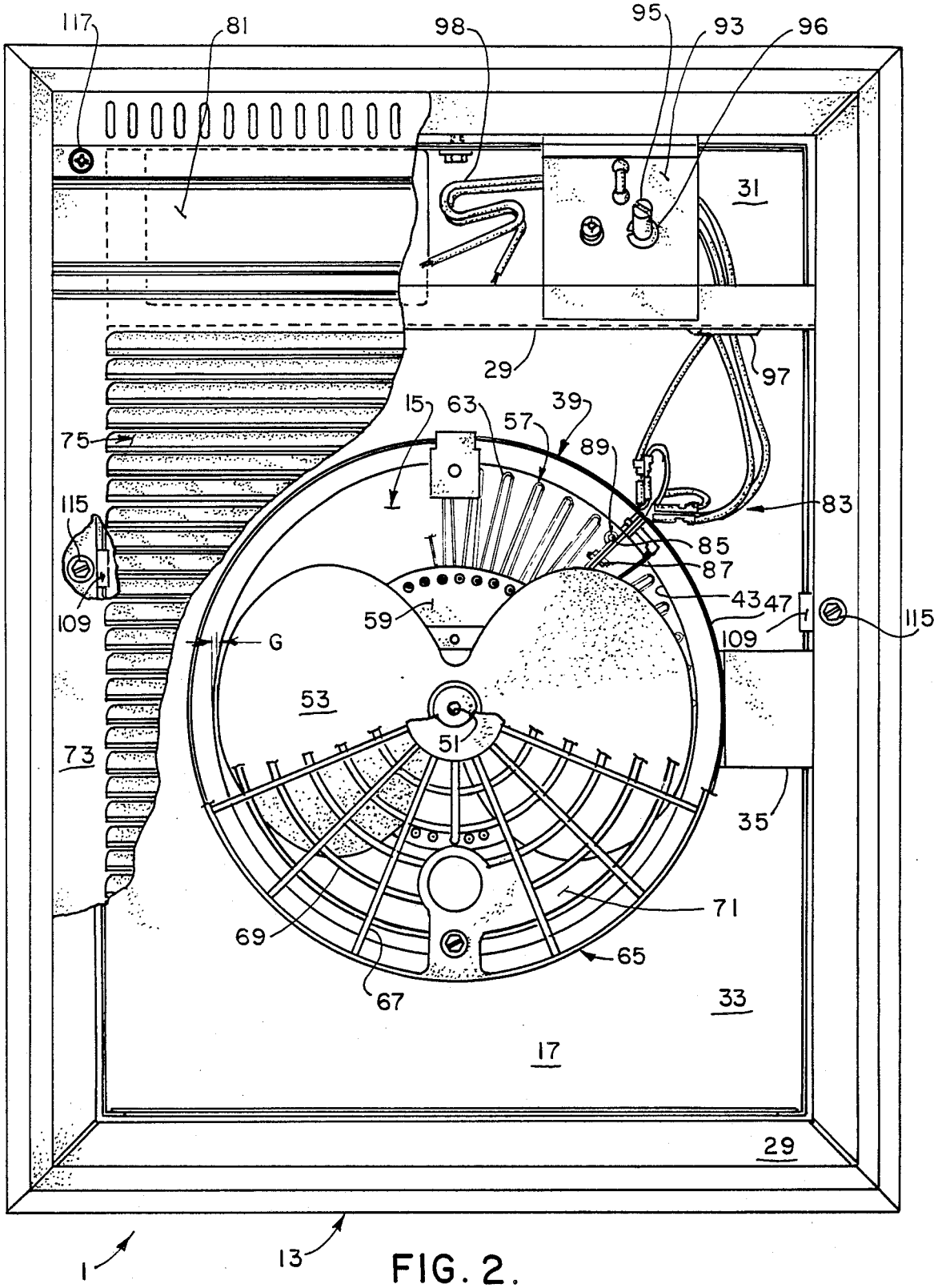
FIG. 2 is an enlarged front elevational view of the assembled wall heater with parts broken away showing the interior construction of the assembled wall heater.
Figure 3:
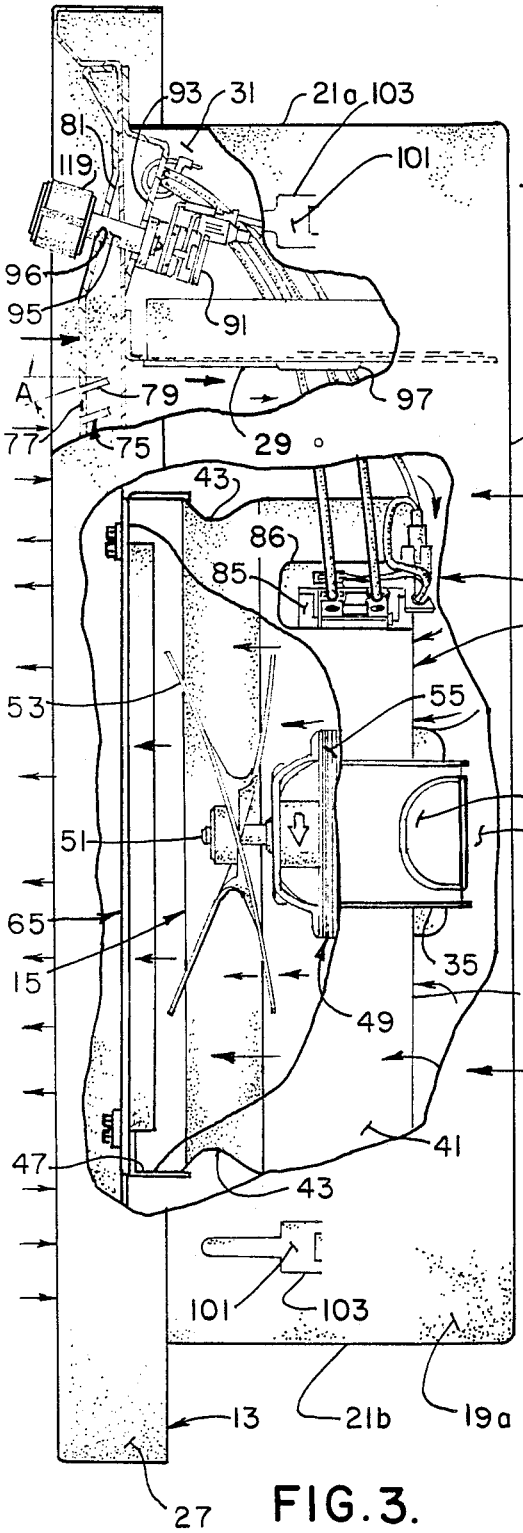
FIG. 3 is a right side elevational view of FIG. 2 with portions broken away showing interior details of the wall heater.

Frame assembly 13 includes a frame 27 extending around the perimeter of the wall heater and adapted to be disposed over the outer edges of side walls **19*a*, 19*b* and end walls 21*a*, 21*b* of wall box 11, with a portion of the frame overlying the marginal portions of wall sheathing 7 defining opening 9 thereby to provide a finished appearance for the wall heater 1 as it is installed in wall 3. The frame assembly further comprises a wiring barrier or partition 29 extending transversely between opposite sides of frame 27 and extending inwardly into wall box 11 when the frame assembly is secured to the wall box such that the wiring barrier or partition 29 cooperates with side walls 19*a*, 19*b* and with end wall 21*a* so as to form a wiring compartment 31, as best shown in FIGS. 1–3. Additionally, wiring barrier 29 defines a heater/blower compartment 33 within wall box 11 on the side of the wiring barrier 29 opposite the wiring compartment 31. Heater/blower assembly 15 is preferably centrally located within heater/blower compartment 33 such that there is a sufficient space surrounding the heater/blower assembly for the intake of room air on all sides of the heater/blower assembly. The exact construction and operation of heater/blower assembly 15** will be hereinafter described in detail.

Frame assembly 13 further includes a heater/blower support 35 extending transversely between opposite sides of frame 27 and reaching inwardly into wall box 11 for mounting heater/blower assembly 15 within heater/blower compartment 33. For purposes as will appear, openings 37 (see FIG. 3) are provided in the heater/blower support along the sides and along transverse reach of support 35 so that the support does not substantially interfere with the flow of inlet air to heater/blower assembly 15.

Heater/blower assembly 15 comprises a venturi, as generally indicated at 39, comprising a duct 41 and a venturi throat 43. The duct has an inlet end 45, with the throat being downstream from the inlet end 45 of duct 41, and with the throat 43 being of lesser cross section than the inlet end 45. Duct 41 has a discharge end 47. An electric motor 49 is securely mounted on heater/-blower support 35 within venturi duct 41. Motor 49 has a rotor shaft 51 located centrally within duct 41, and a two-blade fan 53 is fixedly secured to shaft 51 for rotating therewith. As best shown in FIG. 2, fan blade 53 is positioned within throat 43 so as to have a minimal practical air gap G between the tips of the fan blades 53 and the innermost portions of venturi throat 43. It will be appreciated that by minimizing the air gap G between the tips of blades 53 and the inner reaches of venturi throat 43, the operating efficiency of the fan is maximized, thus increasing delivery volume and delivery pressure of the fan. The lobed shape of fan blades 53 and the relatively precise central mounting of motor 49 within venturi 39 permits air gap G to be maintained to be about 1–2 percent of the diameter of fan blades 53, thus maximizing the efficiency of the fan.

Figure 4:
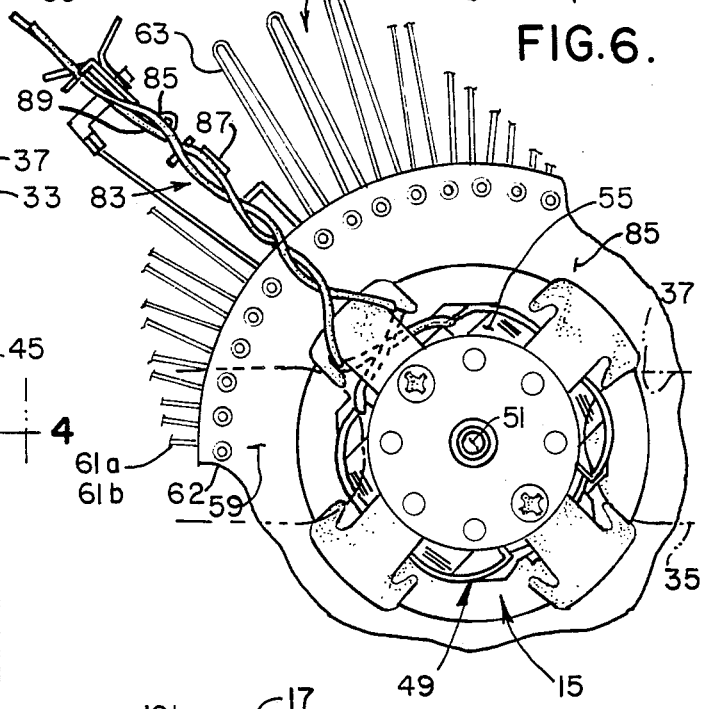
FIG. 4 is a somewhat enlarged view, taken along line 4—4 of FIG. 3 with parts omitted for clarity, illustrating the back of the blower/heater assembly.

Motor 49 includes a stator 55 which, as shown in FIG. 4, is rigidly secured to the central portion of support 35 (shown in dotted lines in FIG. 4). Heater/-blower assembly 15 further comprises an electrical resistance heater, as generally indicated at 57, disposed within venturi 39 and fixedly secured to the central portion of support 35. A pair of heating elements, as indicated at **61*a*, 61*b*, is secured to electrically insulative frame 59 by a plurality of rivets 62. Each of the heating elements 61*a*, 61*b* is comprised of a plurality of radially extending loops 63 which extend outwardly from electrically insulative frame 59, but terminating short of venturi 39. With the heating element loops 63 extending radially outwardly from insulative frame 59, as best shown in FIG. 4, it will be appreciated that the heating element loops are exposed to the maximum velocity air being drawn through venturi 39 by fan blade 53** thereby to maximize the heat transfer coefficient between the heating element loops and the heat transferred to the air flowing through the venturi.

As best shown in FIG. 3, the inlet end 45 of venturi duct 41 is spaced from back wall 17 of wall box 11 a distance sufficient to permit air drawn into heater/-blower compartment 33 on the outside of venturi 39 to be drawn into the inlet end of duct 41 without the creation of any substantial pressure drop or back pressure. Of course, it will be understood that venturi duct 41 is secured to and carried by heater/blower support 35.

An air straightener, as generally indicated at 65, is secured to the discharge end 47 of venturi duct 41 for ensuring that the heated, high velocity air discharged from the venturi discharge end forms a readily defined plume or column of high velocity, heated air which is exhausted outwardly into the room with sufficient velocity such that the heated air, due to its momentum, is prevented from substantially intermingling with room air being drawn into heater/blower compartment 33 on the outside of venturi 39. Air straightener 65 is preferably a unitary grate structure injection molded of a suitable synthetic resin material, such as polycarbonate or the like, capable of withstanding relatively high operating temperatures. Air straightener 65 is shown to comprise a plurality of ribs 67 extending radially outwardly from the center of the air straightener, with the radial ribs 67 being joined by concentric ribs 69 thereby defining a plurality of air openings 71 (FIG. 2).

A grill, as generally indicated at 73, is fixedly secured to frame 27 to close the opening of the frame and to overlie wiring compartment 31 and heater/blower compartment 33. A plurality of generally horizontal louvers 75 is provided in the portion of grill 73 overlying heater/blower compartment 33. Each of these louvers defines a louver opening 77 resulting from a louver fin 79 being struck from the grill, as shown in FIG. 3. In accordance with this invention, louver fins 79 are disposed at an angle A with respect to the horizontal ranging between about 5 degrees and about 25 degrees, and even more preferably about 15 degrees so as to direct the plume or column of heated air discharged from the outlet end 47 of venturi 39 in a generally horizontal, but downward direction. With the louver fins 79 at an angle A with respect to the horizontal ranging between about 5 degrees and 25 degrees, and preferably about 15 degrees, it has been found that the air plume will be directed downwardly into the room without creating any substantial amount of back pressure which would deleteriously affect the operating efficiency of heater/-blower assembly 15. Grill 73 further includes a switch panel 81 which overlies wiring compartment 31. With regard to louver openings 77, it will be particularly noted, in accordance with this invention, that portions of these louver openings overlie portions of the heater/-blower compartment disposed on the outside of venturi 39 and other portions of the louver openings overlie the discharge end 47 of the venturi. Thus, the louver openings 77 simultaneously constitute air inlet openings and air discharge openings in the grill. Further, because grill 73 is preferably a one-piece metal grill, the portions of the grill in register with the plume of heated air discharged from venturi 39 will readily conduct the heat outwardly to regions of the grill cooled by intake air so as to reduce the surface temperature of the portion of the grill in contact with the hot discharge air.

In accordance with the operation of the fan of the present invention, when fan motor 49 and electrical resistance heater 57 are energized, room air will be drawn into heater/blower compartment 33 on the outside of venturi 39 by the portion of louver openings 77 in communication with the portion of the heater/-blower compartment 33 on the outside of venturi 39. The incoming air is directed through the louver openings toward wall box back wall 17. As heretofore described, the inlet end 45 of venturi 39 is spaced from back wall 17 a distance sufficient to permit the incoming air to change its direction approximately 180 degrees and to enter the inlet end 45 of the venturi without creating any substantial pressure drop or back pressure. The air is thus smoothly drawn into the inlet end 45 of the venturi substantially uniformly around the venturi and the inlet air is drawn over the radially extending loops 63 of heating elements **61*a*, 61*b*, so as to substantially uniformly remove heat from all portions of the heating elements. The power of electric motor 49, the characteristics of fan blades 53, the air gap G between the tips of fan blades 53 and the inner reaches of venturi throat 43 all cooperate so as to efficiently draw air into the heater/blower compartment 33 and into the inlet end 45 of the venturi duct 41**. With the velocity of the air flowing through the venturi so controlled, heat is uniformly removed from the heating elements such that no portion of the heating elements glows red, thus ensuring efficient operation of the heater and ensuring that the maximum amount of heat is transferred to the air moving over the heating element, rather than being radiated from the heating elements with attendant radiation heat losses.

Still further in accordance with the operation of wall heater 1 of the present invention, the provision of air straightener 65 located behind grill 73 ensures that a plume or column of heated air is discharged from the outlet and 47 of venturi 39 and is discharged as a plume or column into the room via louver openings 77 in grill 73. As noted above, because of the relatively slight angle A of the louver fins 79 with respect to the horizontal, the grill does not impose any substantial back pressure or pressure drop of the air exhausted from the outlet end of the venturi. Also, air straightener 65 ensures that the air discharged from the venturi remains in a columnar shape without side or eddy currents of heated air circulating back and being caught up in the inlet air being drawn into heater/blower compartment 37 on the outside of venturi 39. More specifically, it has been found that if air straightener 65 is omitted, with grill 73 in place, the heated air discharged from discharge end 47 of venturi 39 will tend to spill over and to become entrained with the air entering heater/blower compartment 33. In short order, a substantial portion of all of the air discharged from the venturi becomes entrained with the inlet air such that a torus is formed such that the heated air is repeatedly circulated over the electrical resistance heating elements 61*a*, 61*b*. This significantly raises the temperature of the outlet air, which in turn causes significant heating of the wall box 11, frame assembly 13, and grill 73. Without air straightener 65 in place, heating elements 61*a*, 61*b* will glow red and the temperature of the wall box 11 can exceed 90° C. (194° F.), the maximum allowable temperatures permitted by Underwriters Laboratories' (U.L.) recommendations. However, with air straightener 65 in place, the heated air discharged from the venturi remains separated from the inlet air such that substantially little or none of the heated discharged air becomes entrained with the inlet air. Thus, a maximum amount of the heated air is forcefully discharged out into the room, and cool room temperature air is drawn into the heater/blower compartment 33.

As best shown in FIGS. 2–4, a motor and heater wiring harness, as indicated at 83, is provided for energizing the electric motor 49 and heating elements 61*a*, 61*b*. Wiring harness 83 is mounted on a rigid electrical insulative sheet 85 which extends radially outwardly from the motor through an opening 86 in the wall of venturi duct 41 (see FIG. 3). A make/break thermal protector switch, 87 (See FIG. 2) is mounted on insulative sheet 85 so as to de-energize the heating elements in the event thermal protector 87 senses the operating temperature of the heater to be above a predetermined limit. Also, a so-called "one-shot" thermal protector 89 is provided on insulative sheet 85 wired in series with thermal protector 87 with the "one-shot" thermal protector 89 operating so as to break electrical current to the heater/blower assembly 15 in the event the operating temperature of the heater exceeds a second predetermined temperature level higher than the temperature level at which thermal protector 87 makes and breaks contact.

A thermostatic switch 91 is mounted on a switch mounting plate 93 carried by frame assembly 13 such that the thermostatic switch is located within wiring compartment 31. Thermostatic switch 91 has a switch shaft 95 which extends out beyond switch mounting plate 93, and which extends through a switch shaft aperture 96 provided in the switch panel 81 of grill 73. A wiring opening 97 is provided in wiring barrier or partition 29 carried by frame 27 such that the motor/-heater wiring harness 83 may be inserted through opening 97 and connected to the respective terminals of thermostatic switch 91. These wiring connections are preferably made at the factory prior to installation of the heater in the wall. As best shown in FIG. 2, electrical leads 98 extend from the thermostatic switch for being connected to power leads from wall 3 in a manner as will be hereinafter described.

In order to mount wall heater 1 in an existing wall 3, the installer first locates two adjacent wall studs 5, as shown in FIG. 6. Then, opening 9 of sufficient size (e.g., 9 and $\frac{1}{4}$ inches $\times$ 12 and $\frac{3}{8}$ inches (23.5 $\times$ 31.4 cm.)) is cut in sheathing 7, with one vertical edge of the opening being in line with one inner face of one of the studs 5. Wall box 11 is then inserted into the wall through opening 9, with one of its side walls (19*a*) in face-to-face engagement with one of the studs 5 (i.e., the rightmost stud, as shown in FIG. 6). Then, nails or screws, as indicated at 99 in FIG. 6, are inserted through apertures 25 in side wall 19*a* so as to positively secure the wall box to one of the studs 5.

Figure 7:
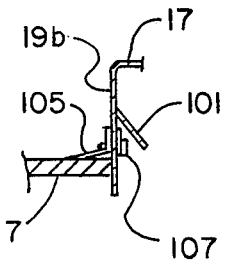
FIG. 7 is an enlarged view, taken along line 7—7 of FIG. 6, illustrating the manner in which the side of the wall box opposite the stud is held captive and supported relative to the wall sheathing.

Foldable tabs 101 in the opposite side wall 19*b* are folded inwardly thereby to provide respective openings 103 in the side wall. A spring clip 105 is inserted into each opening 103 and, as is shown in FIG. 7, the spring clip is secured to side wall 19*b* by means of a suitable screw 107. Tabs 109 are provided on each side wall 19*a*, 19*b* and engage the frame assembly 13 such that the wall sheathing is resiliently held captive between spring clips 105 and frame assembly 13 thereby to at least in part support the portion of wall box 11 opposite the stud 5 to which it is secured by means of nails 99.

As further shown in FIG. 6, a power supply cable 111 from within wall 5 is pulled through knock-out opening 23 and the individual power leads within the cable are stripped for connection to leads 98 in a manner as will be hereinafter described. The power cable is held relative to the side wall 19*b* by means of a clamp 113 applied to the power cable and engageable with the portions of side wall 19*b* surrounding knock-out opening 23.

Figure 5:
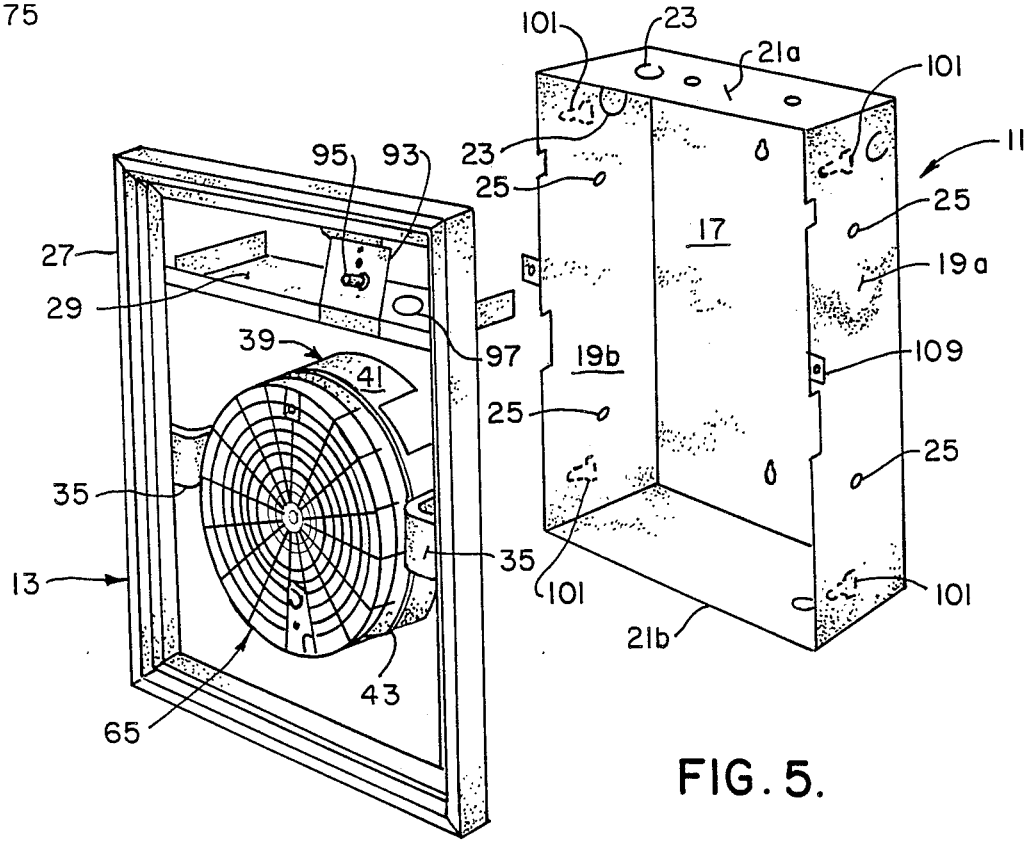
FIG. 5 is an exploded view, on a somewhat enlarged scale as compared to FIG. 1, illustrating the manner in which a frame assembly, including the heater/blower unit, is physically installed within a wall box.

In accordance with this invention, frame assembly 13, having the heater/blower assembly 15 and venturi 39 positively mounted on the heater/blower support 35, is installed as a unit in wall box 11 previously mounted within wall 3, as shown in FIG. 5. More specifically, frame assembly 13 is mounted to the wall box by means of screws 115 (FIG. 2) which engage apertures provided in wall box tabs 109. In this manner, it will be appreciated that the relatively heavy frame assembly 13 carrying heater/blower assembly 15 is mounted to the wall box prior to the connection of heater/blower leads 98 to the power supply cable 111. Additionally, as the frame assembly is installed within the wall box, wiring barrier 29 extends into the wall box and cooperates with side walls 19*a*, 19*b* so as to form wiring compartment 31. In this manner, the portion of the wall box housing leads 98 and the ends of power cable 111 where the electrical connection between the power cable and the heater/blower leads are made, as with wire nuts (not shown), is physically separated from the heater/blower compartment 33, as is required by Underwriters Laboratories (U.L.). Wiring compartment 31 is of sufficient size so as to readily permit the installer to make the wiring connections of leads 98 to power cable 111. It will be appreciated that with frame assembly 13 installed on wall box 11, as described above, the installer need not physically support the weight of the frame assembly in close proximity to the wall box without the frame assembly being installed on the wall box when the electrical connection between leads 98 and power cable 111 is made. This markedly simplifies installation of the wall heater, reduces the complexity, the skill level of the installer required, and significantly lessens the installation time.

After frame assembly 13 has been installed on wall box 11, and after the wiring connections have been made, as above described, grill 73 is installed on the frame assembly 13 by inserting the lower end of the grill into frame 27 and pivotally swinging the grill toward the frame assembly such that thermostatic switch 95 is received in shaft opening 96 provided in switch panel 81 of grill 73. With the grill so installed on the frame assembly, screws 117 (see FIG. 2) are installed so as to positively secure the grill to the frame assembly. Then, a knob 119 may be installed on shaft 95 for controlling operation of thermostatic switch 91. It will be appreciated that switch panel 81 of grill 73 serves the double function of a wiring cover for wiring compartment 33.

In view of the above, it will be seen that the other objects of this invention are achieved and other advantageous results obtained.

As various changes could be made in the above constructions or method without departing from the scope of the invention, it is intended that all matter contained in the above description or shown in the accompanying drawing shall be interpreted as illustrative and not in a limiting sense.

What is claimed is:

1. A wall heater comprising a wall box adapted to be secured to a wall of a room said wall body having an open front, a back wall, and side walls extending from said back wall, a frame assembly secured to said wall box, a heater/blower assembly carried by said frame assembly and being disposed within said wall box when said frame assembly is mounted on said wall box, said heater/blower assembly comprising a venturi having an inlet in spaced relation with respect to said back wall, an outlet, and a throat between said inlet and said outlet an electrical resistance heating element within said venturi, a fan mounted within said venturi for drawing air from said room through said open front into said wall box outside of said venturi, for drawing air into the inlet end of said venturi proximate said back wall of said wall box, for passing said air over said heating element, and for discharging heated air into said room via said outlet, and an air straightener installed on said venturi downstream from said fan for discharging said heated air from said venturi outlet in substantially axial direction with respect to said venturi and for substantially preventing said heated air from being entrained with room air being drawn into said wall box.

2. A wall heater as set forth in claim 1 wherein the inlet end of said venturi is spaced from said back wall a distance sufficient that said air is drawn into said venturi witout substantial pressure drop.

3. A wall heater as set forth in claim 1 wherein said fan comprises an electric motor located generally coaxial within said venturi, and a fan blade rotatably carried by said motor for moving air through said venturi.

4. A wall heater as set forth in claim 3 further comprising a bracket carried by said frame assembly for mounting said venturi and for mounting said motor within said venturi, said bracket having an opening therethrough so as to minimize the interference by said bracket with the air being moved through said venturi.

5. A wall heater as set forth in claim 1 further comprising a grill at least in part overlying said open front of said wall box, said grill being disposed downstream from said air straightener and having a plurality of louvers therein, said grill being secured to said frame assembly such that said inlet air may be drawn into said wall box through portions of said louvers, and so that said heated air may be discharged from said venturi, through other portions of said louvers in said grill, and into said room.

6. A wall heater as set forth in claim 5 wherein each of said louvers comprises a fin struck from said grill forming an opening in said grill, each said fin being inclined downwardly with respect to the horizontal at an angle to the horizontal ranging between about 5 degrees and 25 degrees.

7. A wall heater as set forth in claim 6 wherein said fin is inclined downwardly with respect to the horizontal at an angle of about 15 degrees.

8. A wall heater as set forth in claim 1 wherein said frame assembly includes a partition which, when said frame assembly is installed on said wall box, extends into said wall box and cooperates with said back wall and said side walls of said wall box so as to define a wiring compartment within said wall box.

* * * * *